US006237522B1

(12) United States Patent
Kiyohara et al.

(10) Patent No.: US 6,237,522 B1
(45) Date of Patent: May 29, 2001

(54) BOTTOM STRUCTURE OF PERSONAL WATERCRAFT

(75) Inventors: Kanji Kiyohara, Akashi; Mitsuhiro Yazaki, Kakogawa; Takehiro Nakashima, Akashi; Haruyoshi Maruyama, Kakogawa; Hisashi Fujii, Kobe, all of (JP); Takeshi Sugawara, Lincoln, NE (US)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 0 days.

(21) Appl. No.: 09/527,133

(22) Filed: Mar. 16, 2000

(30) Foreign Application Priority Data

Mar. 23, 1999 (JP) ..... 11-077476

(51) Int. Cl.[7] ..... B63B 1/32
(52) U.S. Cl. ..... 114/290; 114/171
(58) Field of Search ..... 114/55.5, 271, 114/288, 289, 290, 291

(56) References Cited

U.S. PATENT DOCUMENTS 3,363,598 1/1968 Mortrude .
4,702,188 * 10/1987 Harilainen ..... 114/291
5,199,373 * 4/1993 Mardikian ..... 114/290
5,351,642 10/1994 Ackerbloom .

FOREIGN PATENT DOCUMENTS 3-126786 5/1991 (JP) .
4-119292 4/1992 (JP) .
5-139369 6/1993 (JP) .
7-17476 1/1995 (JP) .
7-277267 10/1995 (JP) .
8-268377 10/1996 (JP) .
9-267793 10/1997 (JP) .

* cited by examiner

*Primary Examiner*—Jesus D. Sotelo
(74) *Attorney, Agent, or Firm*—Marshall, O'Toole, Gerstein, Murray & Borun

(57) ABSTRACT

A bottom structure of a personal watercraft enhances the running performance of a personal watercraft. A concavo-convex face (21) having very small concave or convex portions for drawing air from an outside of a watercraft is formed on a water contact face (S) in a bottom surface (20) of the personal watercraft during planing. The air is drawn by the concavo-convex face (21), thereby separating a water flow from the bottom surface (20). Consequently, frictional resistance to the water in the bottom surface (20) can be reduced.

10 Claims, 11 Drawing Sheets

[ FIG.1 ]
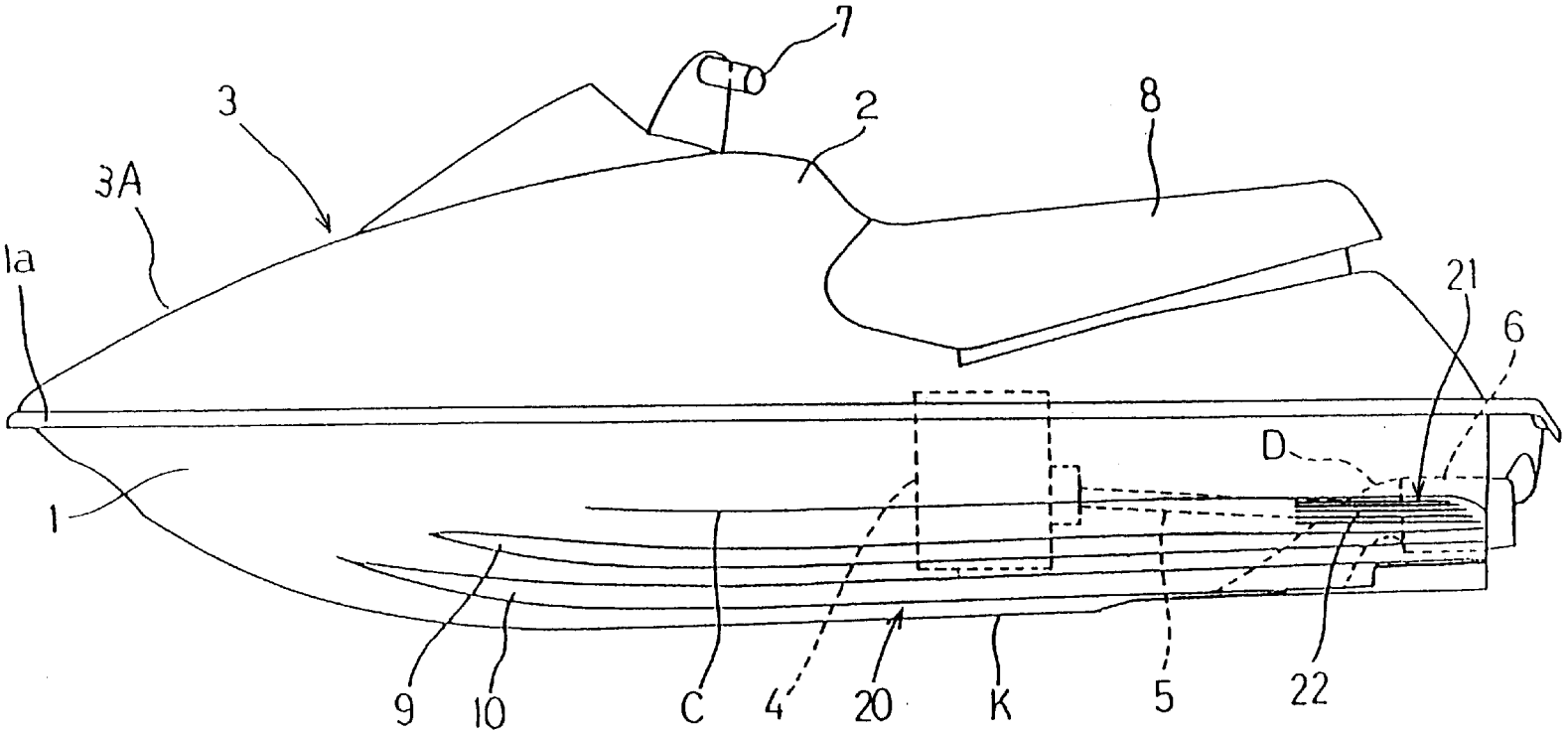

【FIG.2】
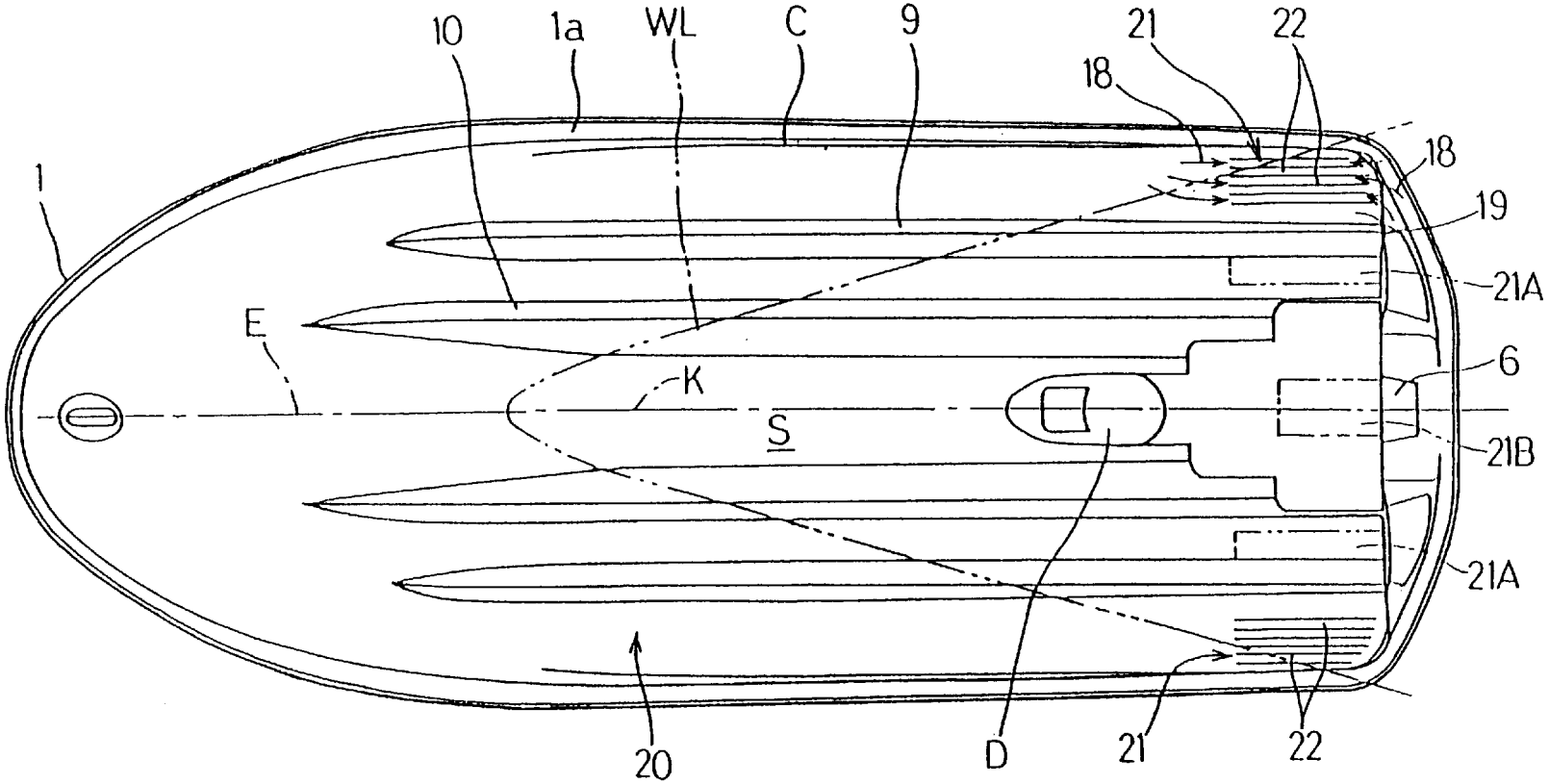

【FIG.3】
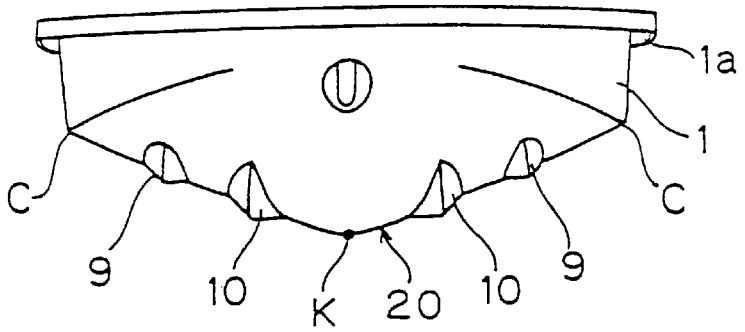
【FIG.4】
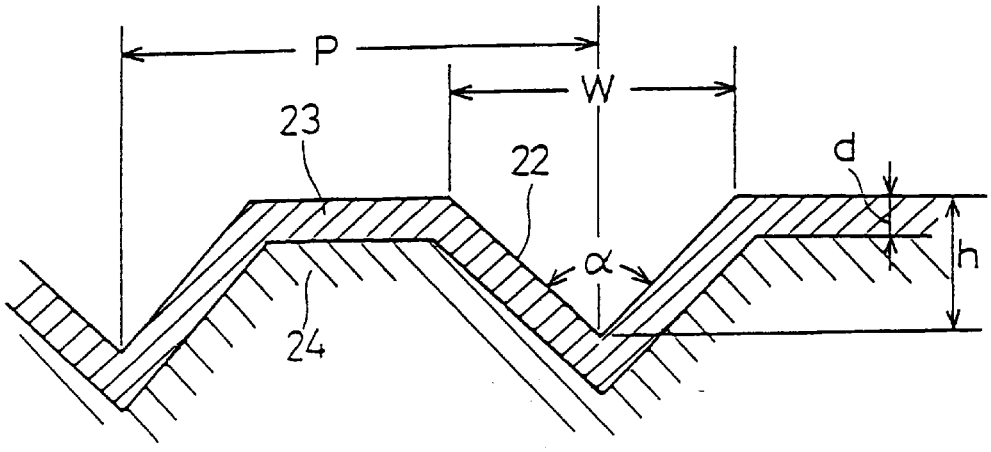
【FIG.5】
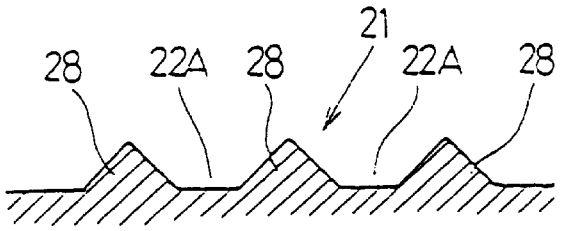

[ FIG.6 ]
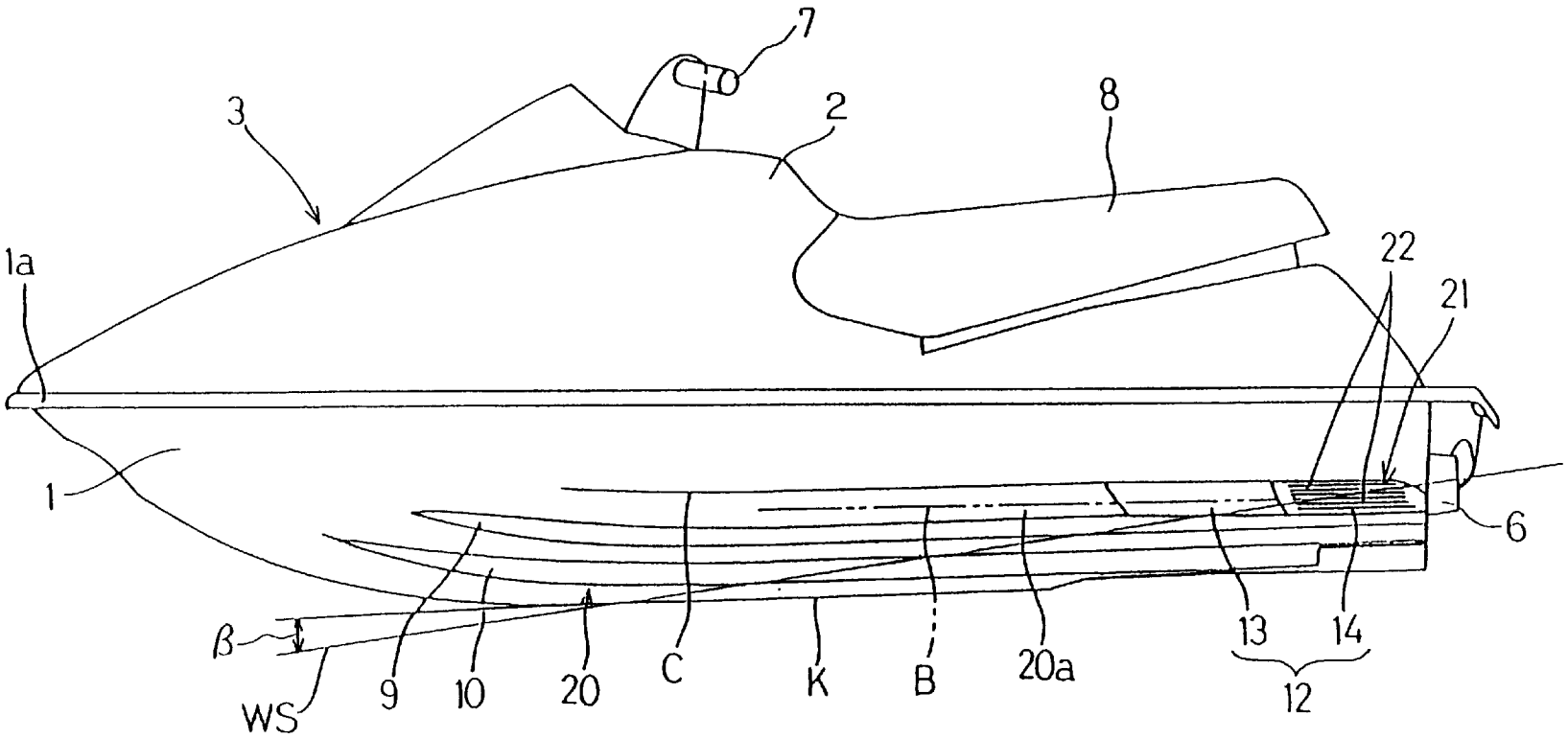

[ FIG.7 ]
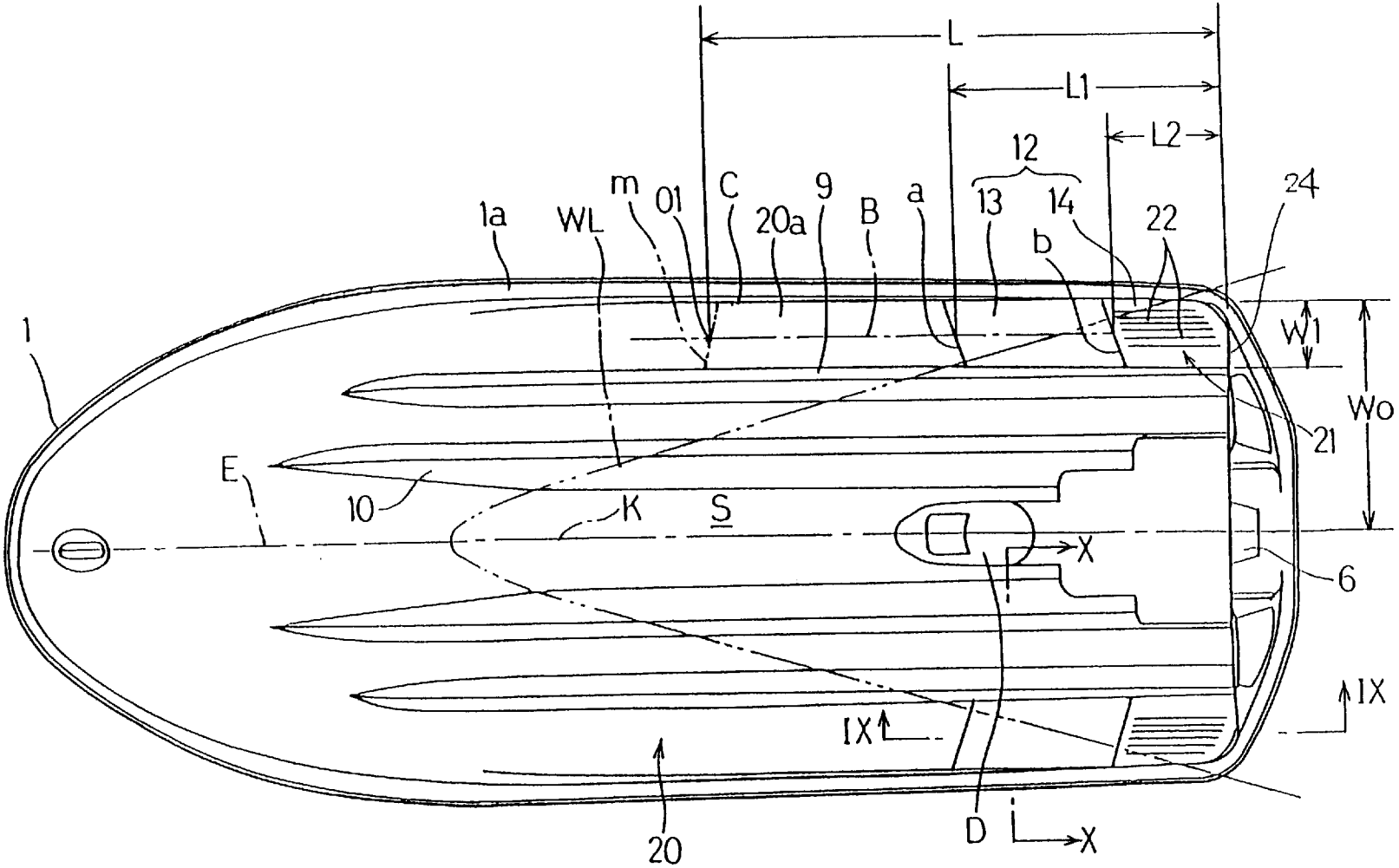

[ FIG.8 ]
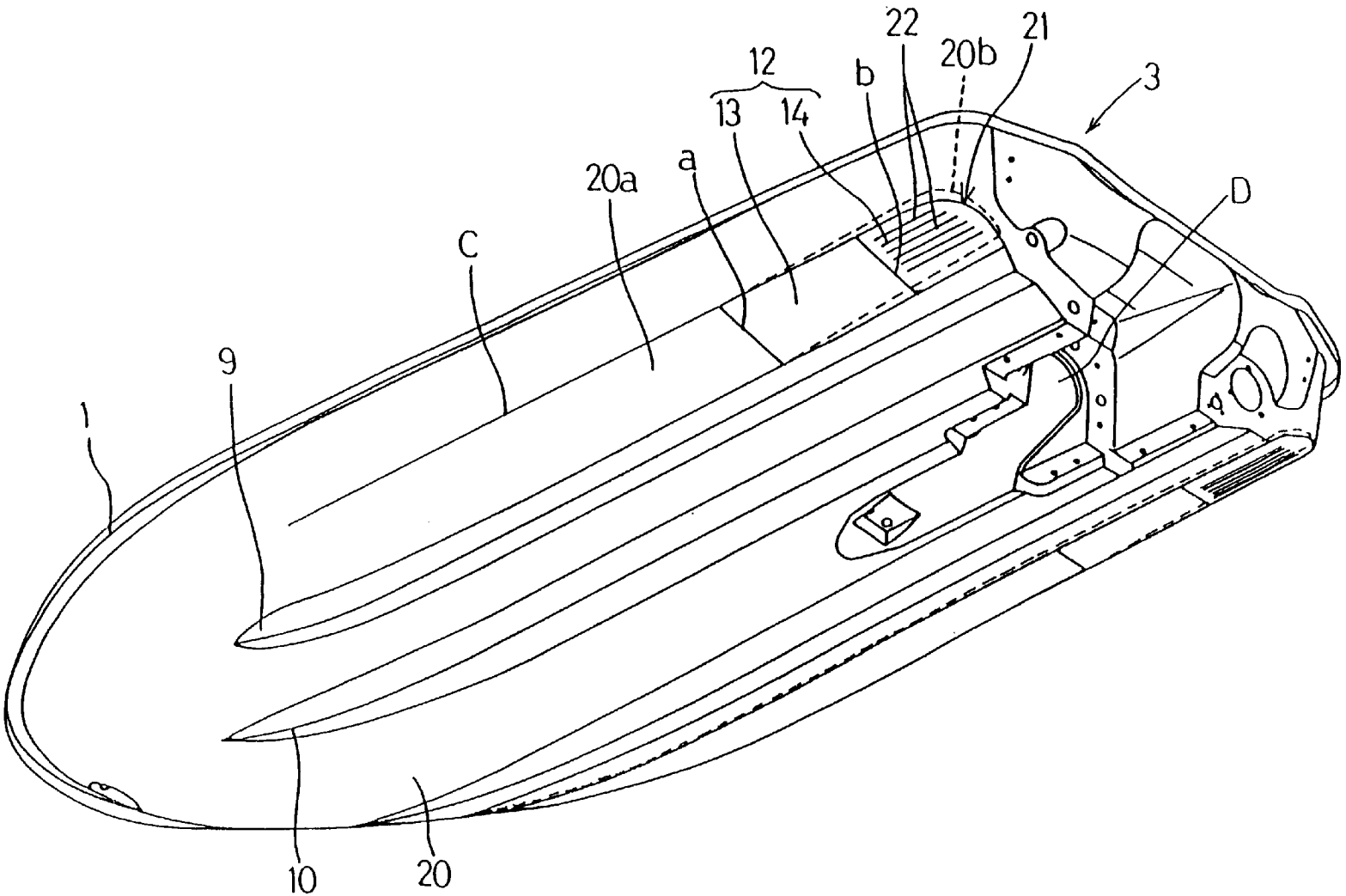

[FIG.9]
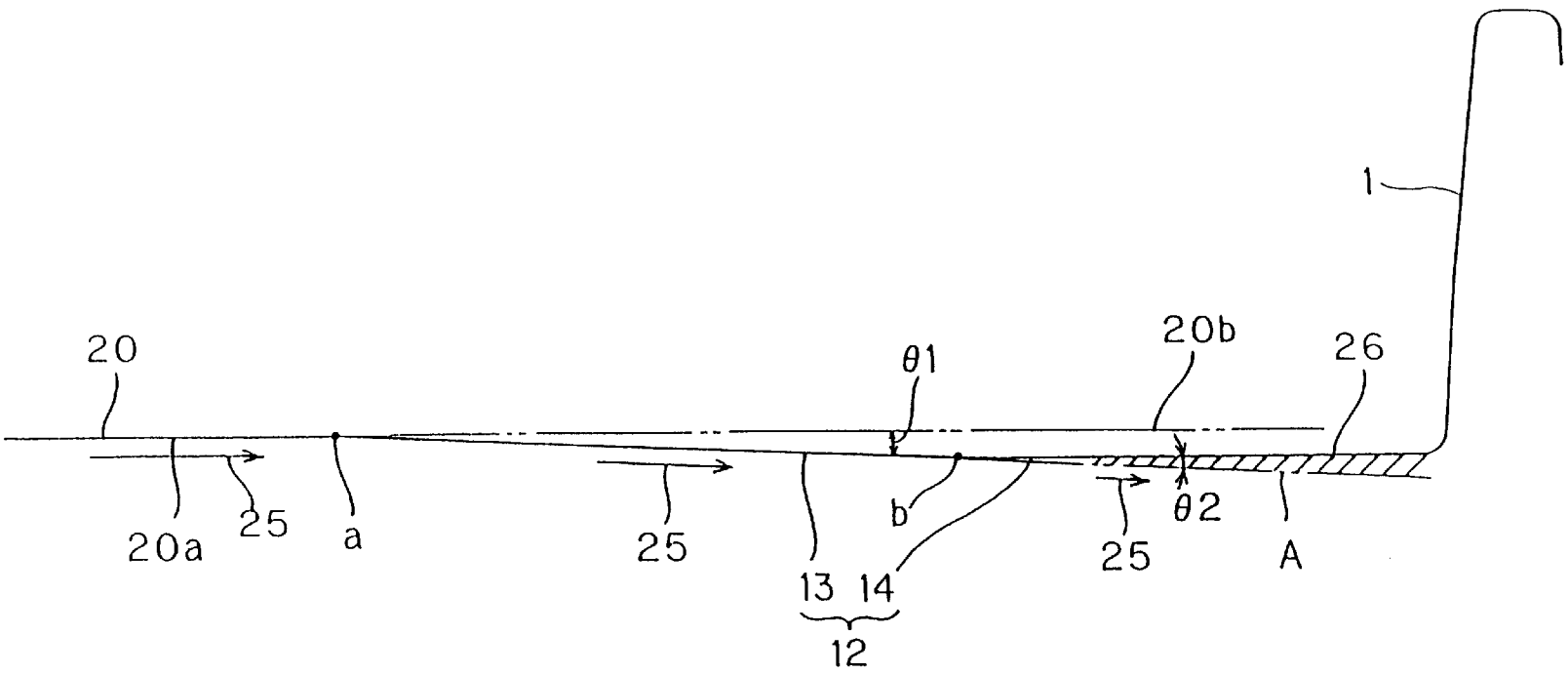

【FIG.10】
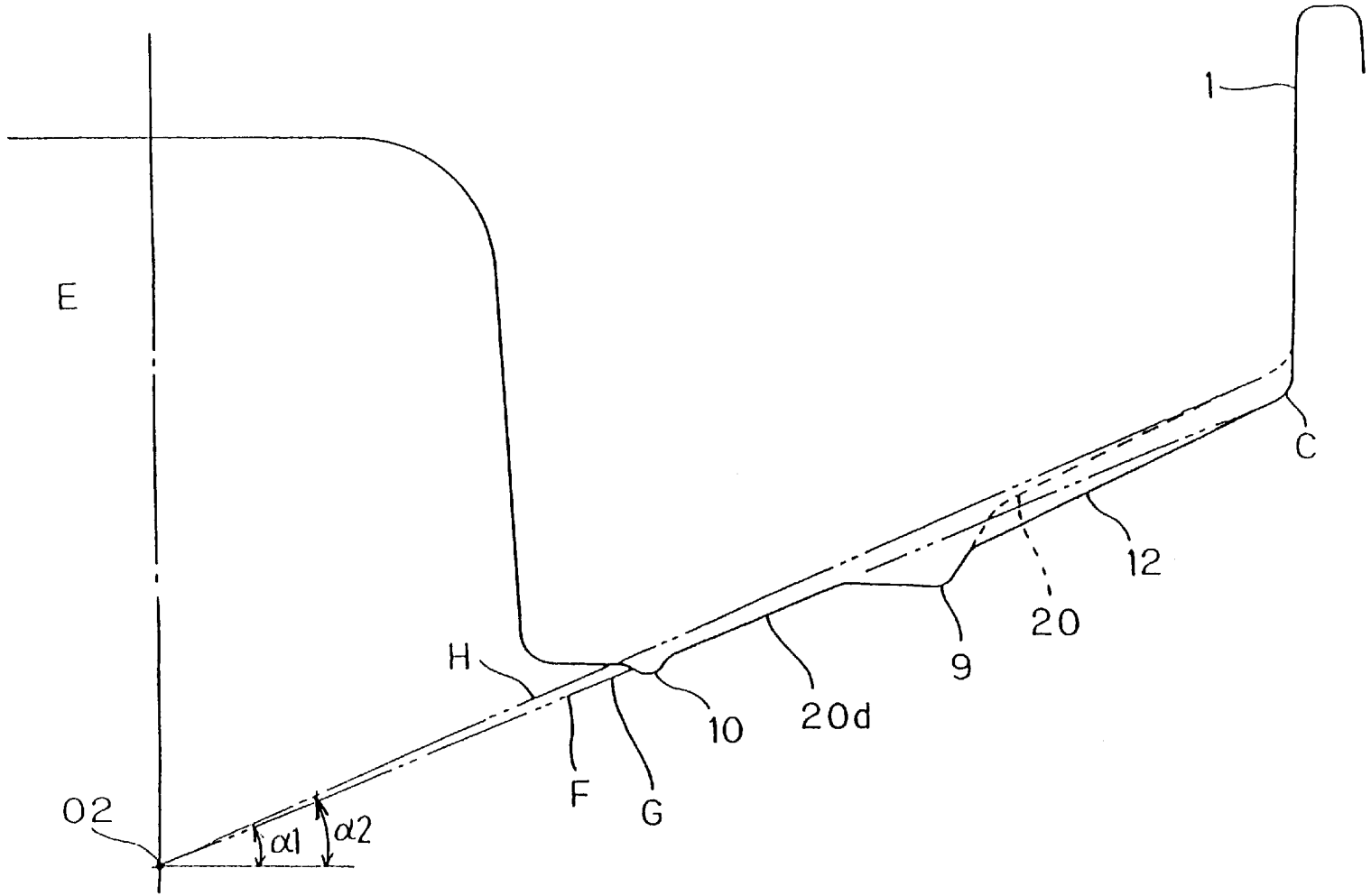

【FIG.11】
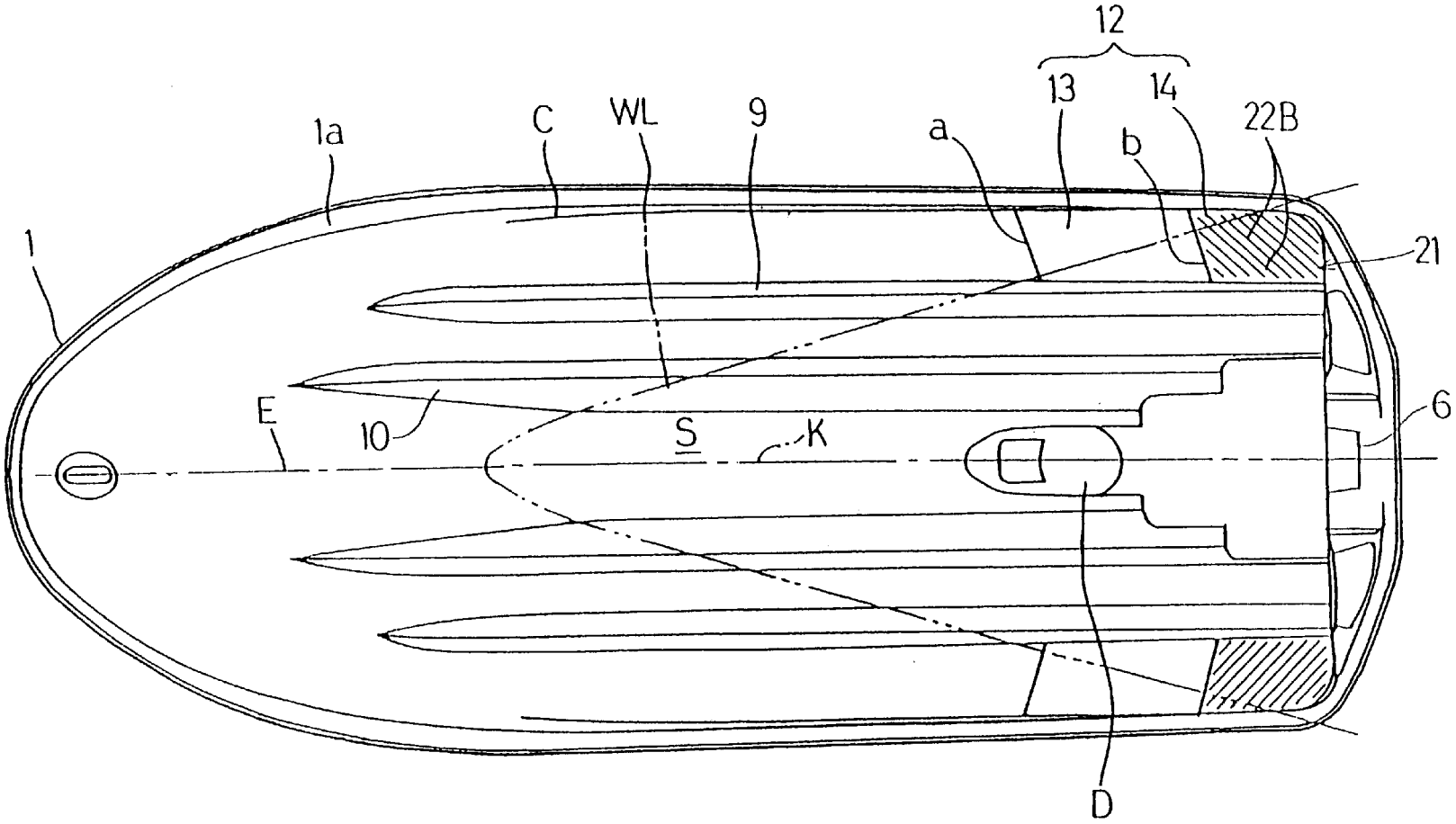

[ FIG.12 ]
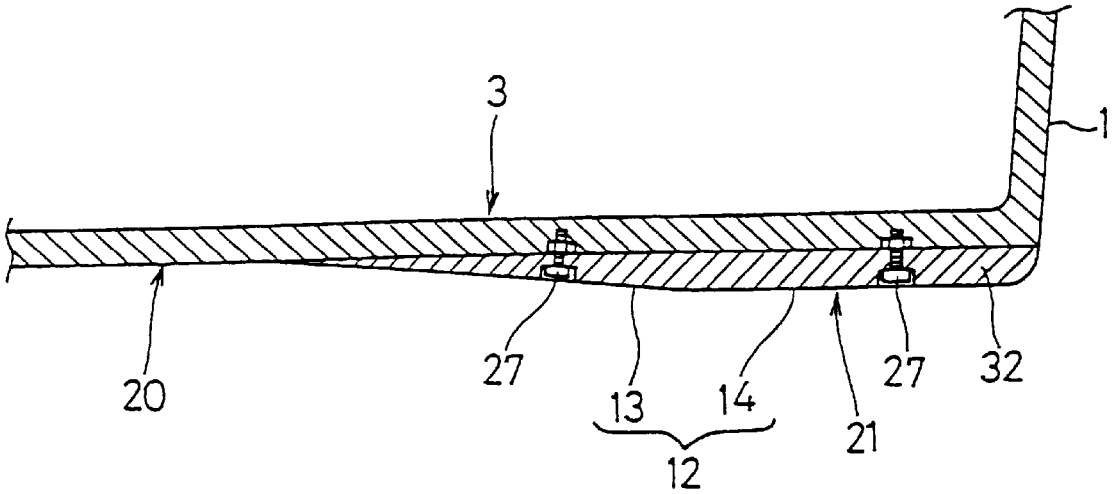

[ FIG.13 ]
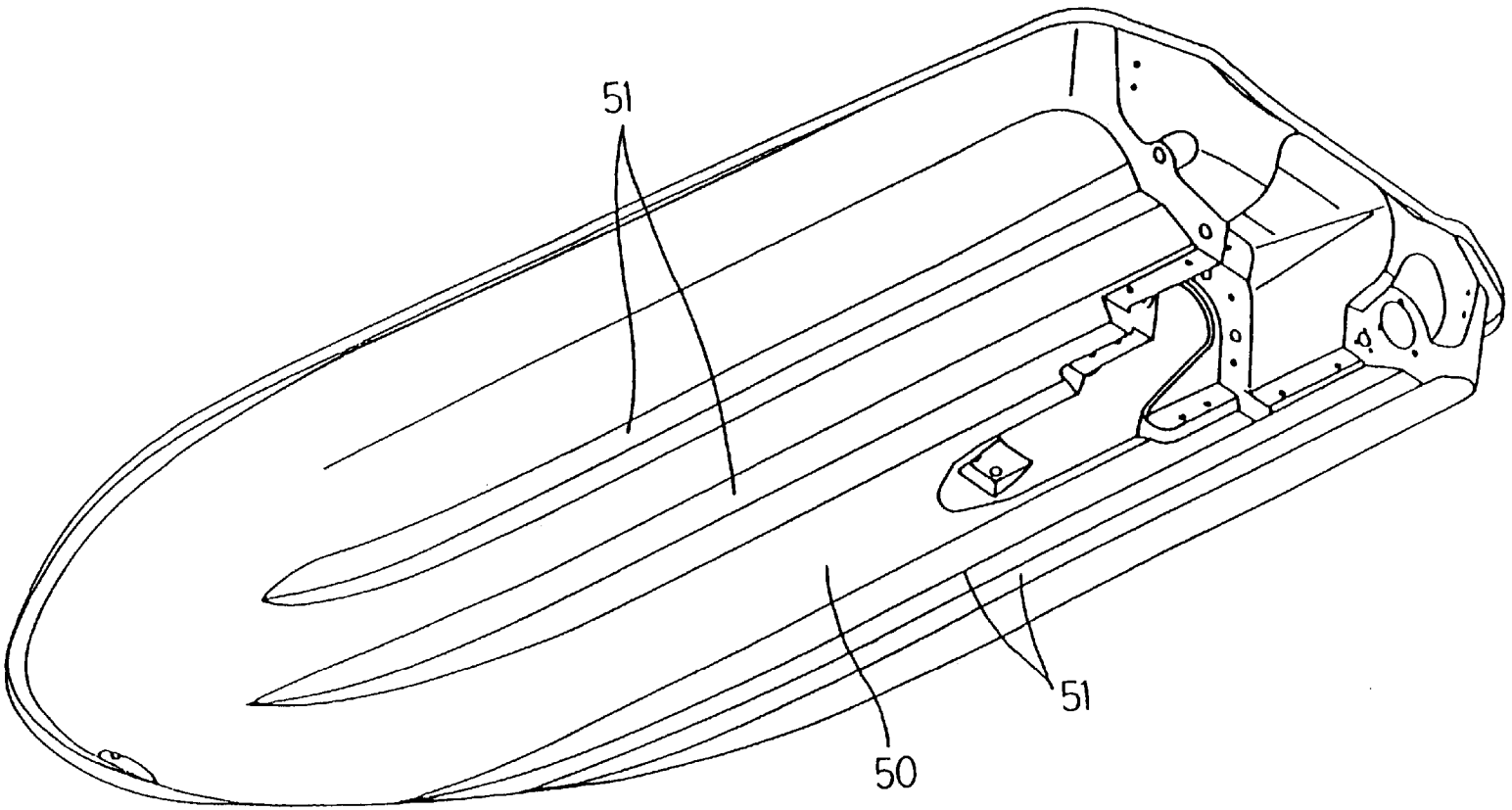

BOTTOM STRUCTURE OF PERSONAL WATERCRAFT

BACKGROUND OF THE INVENTION

1. Field of the Invention

The invention relates to a bottom structure of a personal watercraft (also called a PWC) in which very small concave or convex portions are provided on a bottom surface of the personal watercraft to enhance running performance and to reduce rolling of the watercraft.

2. Description of the Related Art

FIG. 13 shows an example of a hull shape of a conventional personal watercraft. The personal watercraft has a bottom surface 50 having a substantially V-shaped cross section. The bottom surface 50 is provided with a plurality of longitudinal strips 51. A rear part of the bottom surface 50 which forms a planing face of the personal watercraft is a smooth plane in a longitudinal direction of the bottom.

With the above-mentioned shape of the bottom surface 50, however, running performance such as accelerating performance, speed performance is limited due to fluid frictional resistance to water on a water contact face of the bottom during planing. Furthermore, if the water contact face of the watercraft varies between a right side and left side, a difference in dynamic outer forces received from the water flow on the right and left water contact surfaces is generated by repeated separation and sticking of the water on the right and left water contact faces. The difference in dynamic forces creates a difference of dynamic lift forces on the right and left side of the personal watercraft. Due to the difference between right and left dynamic lifts, repetition of small rolling is generated on the watercraft so that an uncomfortable feeling is sometimes given to a rider.

It is a main object of the invention to reduce frictional resistance to the water flow during the running of the personal watercraft, thereby enhancing the running performance.

SUMMARY OF THE INVENTION

In order to achieve the above-mentioned object, a first aspect of the invention is directed to a bottom structure of a personal watercraft in which a concavo-convex face having any one of small concave and convex portions for drawing air from an outside of a watercraft is formed in a part of a water contact face on a bottom surface of the personal watercraft during planing. The concavo-convex face can be formed by grooves, projections, dimples, rough surfaces, and the like.

According to the above-mentioned structure, the air drawn into the concavo-convex face from the outside of the watercraft separates a water flow from a part of the bottom surface of a personal watercraft, to reduce frictional resistance to the water in the bottom surface so that running performance can be enhanced.

A second aspect of the invention is directed to the bottom structure of a personal watercraft according to the first aspect of the invention, wherein at least one pair of concavo-convex faces are provided apart from a longitudinal centerline of the watercraft to a side in laterally symmetrical positions with respect to the longitudinal centerline.

According to the above-mentioned structure, the concave-convex face positioned on the right and left of the watercraft relieves an imbalance of the right and left dynamic forces received from the water flow which is caused by the repetition of separation and sticking of the water flow from and to the hull bottom. Consequently, the rolling caused by the imbalance can be reduced.

A third aspect of the invention is directed to the bottom structure of a personal watercraft according to the second aspect of the invention, wherein the concavo-convex face is formed in an outside portion of a rear part of the bottom surface of the watercraft.

The above-mentioned structure has a function as described below. The outside portion of the rear part of the bottom surface is a portion where the water line usually passes during the planing, and a water contact area varies according to the rolling of the watercraft. Therefore, when the watercraft is inclined to the right side or left side by the rolling, the area of the concavo-convex face is increased on the downwardly inclined side of the water contact faces. With this structure, the increase of the dynamic lift can be prevented on the downwardly inclined side, because the dynamic lift on the concavo-convex face caused by the separation of the water flow from the bottom surface is small. As a result, the rolling of the watercraft can be reduced still further.

A fourth aspect of the invention is directed to the bottom structure of a personal watercraft according to any of the first to the third aspect of the invention, wherein the concavo-convex face has a plurality of longitudinal grooves extended in parallel with the longitudinal centerline of the watercraft.

According to the above-mentioned structure, the water flow in a transverse direction of the watercraft is turned rearward by the longitudinal grooves formed on the concavo-convex face. Therefore, a speed component in a running direction is increased. Correspondingly, the dynamic lift is increased so that the water line is lowered. As a result, the water contact area of the watercraft is reduced. Consequently, the frictional resistance in the bottom surface of the watercraft is reduced. Thus, the running performance can be enhanced still further.

These objects as well as other objects, features and advantages of the invention will become more apparent to those skilled in the art from the following description with reference to the accompanying drawings.

DESCRIPTION OF THE DRAWINGS

FIG. 1 is a side view showing a personal watercraft according to a first embodiment of the invention;

FIG. 2 is a bottom plan view showing the personal watercraft;

FIG. 3 is a front view showing a hull of the personal watercraft;

FIG. 4 is a cross-sectional view showing longitudinal grooves provided on a concavo-convex face of the bottom surface of the hull;

FIG. 5 is a cross-sectional view showing another example of the concavo-convex face;

FIG. 6 is a side view showing a personal watercraft according to a second embodiment of the invention;

FIG. 7 is a bottom plan view showing the personal watercraft;

FIG. 8 is a perspective view showing a bottom surface of a hull of the personal watercraft;

FIG. 9 is an enlarged sectional view taken along the line IX—IX in FIG. 7;

FIG. 10 is an enlarged sectional view taken along the line X—X in FIG. 7;

FIG. 11 is a bottom plan view showing a personal watercraft according to a third embodiment of the invention;

FIG. 12 is a longitudinal sectional view showing a principal portion of a personal watercraft having a resistance reducing structure according to a fourth embodiment of the invention; and FIG. 13 is a perspective view showing a bottom surface of a hull according to the prior art.

DETAILED DESCRIPTION OF THE PREFERRED EMBODIMENT

Preferred embodiments of the invention will be described below with reference to the drawings.

FIG. 1 is a side view showing a personal watercraft having a resistance reducing structure according to a first embodiment of the invention. The personal watercraft 3 includes a body 3A formed by a hull 1 and a deck 2, an engine 4 and a propulsion device 6 such as water-jet pump, which is driven by a propeller shaft 5 connected to a crankshaft of the engine 4. The engine 4 and the propulsion device 6 are provided in the body 3A of the personal watercraft 3. The propulsion device 6 is mounted in a recess (pump chamber) D formed on the bottom of the hull 1. A steering handlebar 7, a seat 8 on which a rider sits, and the like are provided on the deck 2. A bottom surface 20 of the hull 1 has a substantially V-shaped cross section as shown in a front view of FIG. 3. The hull 1 and the deck 2 are formed of a synthetic resin respectively, and are integrally joined at a flange portion 1*a*, thereby constituting the body 3A of the watercraft 3.

As shown in FIG. 2, first and second longitudinal strips 9 and 10 extended almost in parallel with a keel line K are provided in pairs on right and left sides of the bottom surface 20 formed symmetrically with respect to a centerline E extending in a longitudinal direction of the hull 1. The first and second longitudinal strips 9 and 10 are formed to protrude from the bottom surface 20, respectively.

A pair of concavo-convex faces 21 having very small concave or convex portions are formed in a part of a water contact face S of the bottom surface 20 during planing. The concavo-convex faces 21 which serve to draw air from the outside of the watercraft 3 are positioned apart from the centerline E of the watercraft 3 to the side symmetrically on the right side and left side with respect to the centerline E. The water contact face S is an almost triangular region which is surrounded by a water lines WL shown in a two-dotted dashed line in a bottom plan view of FIG. 2. In this case, the concavo-convex face 21 is positioned in both side portions in the base part of the triangle of the water contact face S. More specifically, the concavo-convex face 21 is formed in both lateral (side) portions of the rear part of the bottom surface 20 between the first longitudinal strip 9 positioned on the outermost side in the longitudinal strips and a chine C, i.e. an outer edge of the bottom surface 20 The concavo-convex face 21 has, as small concave portions, a plurality of longitudinal grooves 22 extended in parallel with the centerline E of the hull 1 as seen in a bottom plan view of FIG. 2.

FIG. 4 shows an enlarged cross section of the longitudinal groove 22. The longitudinal groove has a V-shaped cross section. An apex angle $\alpha$ of a bottom of the longitudinal groove 22 is preferably about 60° to about 120°, and more preferably about 80° to about 100°. A groove width W of the longitudinal groove 22 is preferably about 1 mm to about 10 mm, and more preferably about 2 mm to about 6 mm. A pitch P between adjacent longitudinal grooves 22 and 22 is preferably about 2 mm to 20 mm, and more preferably about 4 mm to 12 mm. If the groove width W is less than 1 mm, the volume of a space in the groove for drawing air from outside of the hull tends to be insufficient. If the groove width W is more than 10 mm, a water flow is caused to enter into the groove, and as a result the amount of air drawn into the groove tends to become insufficient. If the groove pitch P is less than 2 mm, the number of the grooves 22 in the necessary area of the concavo-convex face 21 is increased so that the amount of the drawn air tends to be excessive. If the groove pitch P is more than 20 mm, the number of the grooves 22 in the necessary area of the concavo-convex face 21 is decreased so that the amount of the drawn air for separating the water flow from the bottom of the hull also tends to become insufficient.

The bottom of the watercraft 3 is formed by applying a gel coat 23 having a thickness d of about 0.5 mm on a mold and then applying an F.R.P. resin 24 on the gel coat 23. Therefore, if a groove depth "h" of the longitudinal groove 22 is too great, the thickness "d" of the gel coat 23 is ununiform, that is, thin in a bottom portion of the longitudinal groove 22 and thick on an opening side of the longitudinal groove 22, and if the groove depth "h" is too small, the effect of drawing the air by the concavo-convex face 21 is lowered. Therefore, the groove depth "h" is preferably about 0.5 mm to about 3 mm, and more preferably about 1 mm to about 2 mm.

The personal watercraft having the bottom structure mentioned above provides the function described below.

When the personal watercraft is in the planing, the air is drawn into the longitudinal groove 22 of the concavo-convex face 21 mainly from the frontward or rearward of the outside of the watercraft as shown by an arrow 18 in FIG. 2 so that the air separates the water flow from the bottom surface 20 in both rear side portions of the water contact face S. Consequently, the frictional resistance to the water in the bottom surface 20 of the watercraft 3 is reduced, thereby enhancing running performance. Furthermore, an imbalance of right and left dynamic forces on the hull caused by the repetitive separation and sticking of the water flow from and to the hull can be prevented by the concavo-convex face 21 positioned on the right and left of the watercraft 3. Consequently, the rolling of the watercraft 3 caused by the imbalance can be reduced.

The concavo-convex face 21 is formed in the lateral side portion of the rear part of the bottom surface 20 where the water line WL usually passes during the planing. Therefore, a water contact area of the concavo-convex face 21 varies according to the rolling of the watercraft 3. In this bottom structure, if the watercraft 3 is inclined to the right or left by the rolling, the area of the concavo-convex face 21 is increased on the downwardly inclined side of the bottom surface 20. However, the areas of the concavo-convex face 21 creates only a small dynamic lift by the separation of the water flow from the bottom surface 20. Therefore, the increase of the dynamic lift on the downwardly inclined side can be prevented compared with that of the prior art. As a result, the rolling of the watercraft 3 can be reduced still further.

Furthermore, the concavo-convex face 21 is formed by the longitudinal grooves 22 extended in parallel with the centerline E of the watercraft 3, the water flow on the water contact face S which tends to flow in the transverse direction is turned rearward by the longitudinal grooves 22. Therefore, a speed component of a running direction is increased, as a result the dynamic lift is correspondingly increased to lower the water line. As a result, the water contact area is reduced. Consequently, the speed performance of the watercraft can be enhanced still further by the reduction of the frictional resistance in the bottom surface.

The first and second longitudinal strips 9 and 10 also have the function of separating the water which flows oblique to the running direction from the bottom surface 20. In the present embodiment, therefore, the concavo-convex face 21 having the longitudinal grooves 22 are slightly separated from the longitudinal strip 9 to the outside of the bottom in such a manner that the concavo-convex face 21 does not position on a separation region 19 of the water formed by the first longitudinal strip 9. Consequently, the water separating function can be shared efficiently.

While the concavo-convex face 21 has the longitudinal grooves 22 in the present embodiment, it may have a plurality of protruded strips 28 extended in parallel with the centerline E of the watercraft 3 as shown in a cross-sectional view of FIG. 5 for example. In this case, a longitudinal groove 22A can be formed on a position between adjacent strips 28 and 28. In the same manner as in the above-mentioned embodiment, therefore, the speed performance can be enhanced and the rolling can be reduced. Furthermore, the grooves of the concavo-convex face 21 are not restricted to the longitudinal grooves 22 parallel with the centerline E of the watercraft 3 but may be a plurality of grooves forming a predetermined angle with respect to the centerline E of the watercraft 3 seen in a bottom plane view, for example, oblique grooves forming an acute angle or transverse grooves forming an angle of 90°. Also in this case, the running performance of the watercraft 3 can be enhanced, because the air is drawn into the concavo-convex face 21 so that the water flow is separated from the bottom surface 20 of the watercraft 3. Also, the same effects can be obtained when the concavo-convex face 21 is formed with a rough surface or a surface having very small concave portions such as partially spherical dimples.

Furthermore, the concavo-convex faces are not limited to a pair of right and left concavo-convex faces 21 as mentioned above, but another pair of concavo-convex faces 21A may be added between the first and second longitudinal strips 9 and 10 such as shown in FIG. 2 for example. The concavo-convex face 21 is not always provided in laterally symmetrical positions apart from the centerline E but may be provided in a position on the centerline E of the bottom surface 20, shown as a concavo-convex face 21B for example.

FIGS. 6 and 7 are side view and bottom plan view showing a personal watercraft according to a second embodiment of the invention. FIG. 8 is a perspective view showing a bottom surface of a hull 1 of the personal watercraft 3 with a propulsion device 6 removed. In these drawings, the same portions as in the first embodiment or corresponding portions have the same reference numerals. In this personal watercraft, a bulging face 12 is formed between a first longitudinal strip 9 positioned on the outermost side and a chine C of an outer edge of a bottom surface 20 in both sides of a rear part of the bottom surface 20 shown in FIG. 7, and the same concavo-convex face 21 as in the above-mentioned embodiment is formed in a part of the bulging face 12.

As shown in FIG. 9, the bulging face 12 has a fore part 13 inclined downward in the rearward direction and a rear part 14 positioned above a virtual extended face A and formed continuously from the fore part 13 with bent stepless. The fore part 13 is flat, and the rear part 14 has a concavo-convex face 21 having a plurality of longitudinal grooves 22 extended in parallel with a centerline E of the watercraft 3 as seen in a bottom plane view. The whole bulging face 12 is formed to be bulged downward with respect to a face 20*b* (a portion shown by a dotted line in FIG. 8) extended rearward from a front face 20*a* in the bottom surface 20.

Detailed description will further be given fore part 13 of the bulging face 12 is inclined downward in the rearward direction at a predetermined angle θ1 with respect to the front face 20*a* backward from a first edge line "a", i.e. a boundary with the front face 20*a*. The angle θ1is about 1° to about 3°, preferably about 1.5° to about 2.5°. The rear part 14 of the bulging face 12 is bent on a second edge line "b", i.e. a boundary with the fore part 13, and is inclined upward in the rearward direction at an angle θ2 with respect to the virtual extended face A extended rearwardly from the fore part 13. In this embodiment, the rear part 14 is formed in parallel with the extended face 20*b* of the front face 20*a*.

Furthermore, it is preferable that the bulging face 12 should be provided in a rear part of the hull 1 in order to generate a top (head) lifting moment. Accordingly, the fore part 13 and the rear part 14 of the bulging face 12 are formed in the positions of the bottom surface 20 described as follows. As shown in FIG. 7, a front edge of a portion formed by a flat plane on the front face 20*a* positioned in front of the bulging face 12, that is, an intersection line of a flat portion and a curved portion curved upwardly from the front of the flat portion is represented as "m". When a distance from an intersection point O1 of the front edge "m" of the flat portion and a buttock line B (which is parallel with a keel line K seen in a plane view) passing through the center of the bulging face 12 in a lateral direction to a rear edge 24 of the bottom surface 20 is represented as L. A position L1 of the first edge line "a" on the buttock line B is set to (¼ to ¾) L apart from the rear edge 24. A position L2 of the second edge line b on the buttock line B is set to (⅛ to ⅝) L. Then a length (L1–L2) of the fore part 13 of the bulging face 12 is set to (⅛ to ⅝) L. A water line WL, when the personal watercraft planes at a full speed, is shown by a two-dotted dashed line in FIG. 7. Accordingly, most of the bulging face 12 is included in a part of a planing face during the planing at a full speed. When the speed is lowered, the water line WL moves forward in the bottom surface 20, and then, all the bulging face 12 is included in the planing face.

Furthermore, the bulging face 12 is arranged apart laterally from the centerline E of the hull 1 on the outer side of the hull bottom 20 in order to reduce the rolling of the watercraft 3. More specifically, it is preferable that a width W1 of the bulging face 12 seen from a bottom side should be set to ⅓ to ⅔ of a half width W0 of the bottom surface 20 apart from the chine C, i.e. the outer edge of the bottom surface 20*a*.

As shown in FIG. 6, furthermore, each of the buttock lines B in the front face 20*a* of the vicinity of the fore part 13 and in the rear part 14 is set in parallel with the keel line K as seen in a side view.

The function of the above-mentioned structure will be described below.

Also in the present embodiment, air is drawn by the concavo-convex face 21 so that the water flow is separated from the bottom surface 20 in the same manner as in the first embodiment. Therefore, frictional resistance of the watercraft 3 to the water in the bottom surface 20 is reduced so that the running performance of the watercraft 3 can be enhanced and the rolling of the watercraft 3 can also be reduced. The concavo-convex face 21 is formed in the outside portion of the rear part of the bottom surface 20. Therefore, the rolling of the watercraft 3 can be reduced still further.

Furthermore, the concavo-convex face 21 has a plurality of longitudinal grooves 22 extended in parallel with the centerline E of the watercraft 3. Therefore, the running performance of the watercraft 3 can be enhanced still further.

In addition to the above-mentioned effects of the concavo-convex face 21, the following advantages can be obtained by the bulging face 12. During the planing, a water flow 25 along the hull 1 is turned downward as shown in FIG. 9 by means of the fore part 13 of the bulging face 12 inclined downward in the rearward direction. Consequently, separation of the water flow 25 is caused in the rear part 14 so that a negative pressure region 26 is generated on the underside of the rear part 14. By the negative pressure, the rear part 14 is attracted to the water flow 25 so that a bow (head) is lifted up. Consequently, an angle of trim β obtained during high-speed planing shown in FIG. 6 (an angle formed by an aft straight line portion of the keel line K and a water surface WS) approximates to an optimal angle of trim so that the frictional resistance of the watercraft 3 to the water can be reduced, resulting in an enhancement in the running performance of the watercraft 3.

The bulging face 12 bulges downward on the bottom surface 20 shown in FIG. 7. Therefore, a V angle of the bottom surface 20 in a portion where the bulging face 12 is to be formed is smaller than in the related art. More specifically, as shown in FIG. 10, if an intersection point of a centerline E passing through the center of the hull 1 in a cross direction and an extended line F of a central portion 20*d* on the inside of the first longitudinal strip 9 of the bottom surface 20 is represented as O2, a V angle of an outside bottom line G (which is coincident with the line F in this example) connecting the intersection point O2 with the peripheral edge of the bulging face 12 (the chine C in this example) is represented as β1, and a V angle of an outside bottom line H connecting the intersection point O2 with the peripheral edge of the bottom surface 20 having no bulging face 12 is represented as α2, thus the relation $\alpha 1<\alpha 2$ is obtained. Thus, the V angle becomes smaller so that the rolling of the watercraft 3 can further be reduced.

The bulging face 12 is formed between the first longitudinal strip 9, i.e. outside strip on the bottom surface 20 and the chine C. Therefore, the V angle of the central portion 20*d* of the bottom surface 20 (coincident with α1 in this embodiment) is identical to that obtained in the conventional case where the bulging face 12 is not provided. Thus, the course stability which is generally deteriorated by a reduction in the V angle can be kept as in the conventional case.

As shown in FIG. 9, furthermore, the rear part 14 of the bulging face 12 and the fore part 13 is formed continuously by bending. There is no step portion formed between the fore part 13 and the rear part 14. Therefore, high running performance can be kept because there is no resistance of a water flow caused by any step portion.

As shown in FIG. 6, each of the buttock lines B in the front face 20*a* in the vicinity of the fore part 13 and in the rear part 14 is set in parallel with the keel line K as seen in a side view. Consequently, upward angle θ2 of the rear part 14 (FIG. 9) is properly formed so that proper lifting can be performed. Consequently, an optimal lifting up of the bow is generated, and an optimal angle of trim β can be obtained.

FIG. 11 is a bottom plan view showing a personal watercraft according to a third embodiment of the invention. In FIG. 11, the same portions as in the second embodiment or corresponding portions have the same reference numerals. Also in the personal watercraft, a bulging face 12 is formed between a first longitudinal strip 9 positioned on the outermost side and a chine C, i.e. an outer edge of a bottom surface 20 in both outside portions of a rear part of the bottom surface 20 and a concavo-convex face 21 is formed in a part of the bulging face 12 in the same manner as in the second embodiment.

The bulging face 12 is the same as in the second embodiment. The concavo-convex face 21 having a plurality of oblique grooves 22B formed in predetermined angle with respect to a centerline E of a watercraft 3 as seen in a plane view is formed in an rear part 14 of the bulging face 12.

Also in the present embodiment, the running performance can be enhanced and the rolling of the body 3A can be reduced by the water separating functions of the concavo-convex face 21 and the bulging face 12 in the same manner as in the second embodiment.

Instead of the bulging face 12 in the second and third embodiments, in a fourth embodiment shown by a longitudinal sectional view of FIG. 12, a bulging face 12 is formed on a lower face of a plate member 32 formed of plastic material as a separate attaching member to the hull 1 of watercraft 3, and the plate member 32 is fastened to the bottom surface 20 with a fixture such as a bolt 27 or is stuck to the bottom surface 20 with an adhesive. Thus, the bulging face 12 in the bottom surface 20 is formed. In the same manner as in the second and third embodiments, a concavo-convex face 21 having very small concave or convex portions such as longitudinal grooves 22 or oblique grooves 22A is formed in the rear part 14 of the bulging face 12.

Also in the fourth embodiment, the running performance can be enhanced and the rolling of the body 3A can be reduced by the water separating functions of the concavo-convex face 21 and the bulging face 12. Furthermore, the bulging face 12 having the concavo-convex face 21 is provided by fixing the plate member 32 to the bottom surface 20 of the body 3A. Therefore, the bulging face 12 having the concavo-convex face 21 can easily be provided on the bottom surface 20. The bulging face 12 having the concavo-convex face 21 can easily be added to a bottom surface 50 of the existing personal watercraft shown in FIG. 13.

What is claimed is:

1. The bottom structure of a personal watercraft comprising a hull having a bottom of substantially V-shaped cross section, longitudinal strips extending substantially parallel with a keel and provided in pairs on right and left sides of a bottom surface symmetrically with respect to a longitudinal centerline of the hull, and, a concavo-convex face formed in both lateral portions of a rear part of the bottom surface between the longitudinal strip and outside portions of the bottom surface, said concavo-convex face having a plurality of longitudinal grooves extended in parallel with the centerline of the hull enabling air to be drawn into each of the plurality of longitudinal grooves to reduce the frictional resistance of the bottom surface to water.

2. The bottom structure of a personal watercraft according to claim 1, wherein the width of each of said longitudinal grooves is about 1 mm to about 10 mm, and the pitch between adjacent longitudinal grooves is about 2 mm to about 20 mm.

3. The bottom structure of a personal watercraft according to claim 1, wherein said longitudinal grooves are formed outwardly of and spaced apart from the longitudinal strip extended on the outermost side of the hull.

4. The bottom structure of a personal watercraft of claim 1, wherein the longitudinal grooves are formed by recessing portions of the bottom surface.

5. The bottom structure of a personal watercraft of claim 4, wherein a flat portion is formed between the adjacent two longitudinal grooves of the plurality of longitudinal grooves such that said flat portion extends along the longitudinal grooves.

6. The bottom structure of a personal watercraft of claim 1, wherein each of said concavo-convex faces includes a plurality of convex portions having a predetermined length formed on the bottom surface and each of the longitudinal grooves is formed between adjacent two convex portions of the plurality of convex portions.

7. The bottom structure of a personal watercraft of claim 6, wherein the depth of the recesses of the longitudinal grooves below the bottom surface is smaller than the height of protrusions of the longitudinal strips above the bottom surface.

8. The bottom structure of a personal watercraft comprising a hull having a bottom of substantially V-shaped cross section, longitudinal strips extending substantially parallel with a keel and provided in pairs on right and left sides of a bottom surface symmetrically with respect to a longitudinal centerline of the hull, and, a concavo-convex face formed in both lateral portions of a rear part of the bottom surface between the longitudinal strips and outside portions of the bottom surface, said concavo-convex face has a plurality of oblique grooves forming an angle with respect to the longitudinal center of the hull.

9. The bottom structure of a personal watercraft comprising a hull having a bottom of substantially V-shaped cross section, longitudinal strips extending substantially parallel with a keel and provided in pairs on right and left sides of a bottom surface symmetrically with respect to a longitudinal centerline of the hull, a concavo-convex face formed in both lateral portions of a rear part of the bottom surface between the longitudinal strip and outside portions of the bottom surface, and a bulging face having a fore part inclined downwardly in the rearward direction and a rear part positioned above a virtual extended face extended rearwardly from the fore part, and formed continuously from the fore part with a bent stepless portion being provided on both lateral portions of a rear water contact surface of the bottom surface of the hull during planing, said concavo-convex face being provided on the rear part.

10. The bottom structure of a personal watercraft according to claim 9, said concavo-convex face has a plurality of longitudinal grooves extended in parallel with the centerline of the hull.

* * * * *